US009243366B2

(12) United States Patent
Pretsch et al.

(10) Patent No.: US 9,243,366 B2
(45) Date of Patent: Jan. 26, 2016

(54) METHOD AND DEVICE FOR MANUFACTURING A SHEET-LIKE SUBSTRATE

(71) Applicant: GIESECKE & DEVRIENT GMBH, Munich (DE)

(72) Inventors: Andreas Pretsch, Holzkirchen (DE); Bernhard Wiedner, Miesbach (DE); Manfred Heim, Bad Tolz (DE); Michael Dornfeld, Sachsenkam (DE); Johannes Kemper, Schwifting (DE); Johannes Beier, Warngau (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 14/350,121

(22) PCT Filed: Oct. 4, 2012

(86) PCT No.: PCT/EP2012/004155
§ 371 (c)(1),
(2) Date: Jul. 29, 2014

(87) PCT Pub. No.: WO2013/050150
PCT Pub. Date: Apr. 11, 2013

(65) Prior Publication Data

US 2014/0332174 A1 Nov. 13, 2014

(30) Foreign Application Priority Data

Oct. 7, 2011 (DE) ..... 10 2011 115 133

(51) Int. Cl.
*D21H 21/48* (2006.01)
*B42D 25/355* (2014.01)
(Continued)

(52) U.S. Cl.
CPC ..... *D21H 21/48* (2013.01); *B42D 15/0026* (2013.01); *B42D 25/355* (2014.10); *D21H 21/42* (2013.01)

(58) Field of Classification Search
CPC ..... D21H 21/42; D21H 21/48; D21H 21/40; D21H 27/34; B42D 25/355; B42D 15/0026; B42D 2033/28; D21F 1/44; D21F 11/006
See application file for complete search history.

(56) References Cited

U.S. PATENT DOCUMENTS 4,462,866 A 7/1984 Tooth et al.
5,405,500 A * 4/1995 Knight ..... 162/103
(Continued)

FOREIGN PATENT DOCUMENTS

CN 1584203 A 2/2005
DE 102008029638 A1 * 12/2009 ..... B42D 15/00
(Continued)

OTHER PUBLICATIONS

International Search Report and Written Opinion from International Application PCT/EP2012/004155, Mar. 25, 2013.
(Continued)

*Primary Examiner* — Jose Fortuna
(74) *Attorney, Agent, or Firm* — Workman Nydegger

(57) ABSTRACT

A method includes manufacturing a sheet-type substrate having a security thread in which a security thread having features spaced apart from one another in the longitudinal direction of the security thread is inserted into the substrate in such a way that it is at least partially embedded in the substrate. At least one of the features is displayed as an image after the embedding of the security thread. The stretch of the embedded security thread in the longitudinal direction is calculated based on the image of the at least one feature, and the region of the substrate in which the calculated stretch of the security thread exceeds a specified maximum stretch is obliterated depending on the calculated stretch.

11 Claims, 3 Drawing Sheets

(51) Int. Cl.
*D21H 21/42* (2006.01)
*B42D 15/00* (2006.01)

(56) References Cited

U.S. PATENT DOCUMENTS

| | | | | |
|---|---|---|---|---|
| 5,509,691 | A * | 4/1996 | Kaule et al. | 283/67 |
| 6,447,630 | B1 | 9/2002 | Disano et al. | |
| 7,264,691 | B2 * | 9/2007 | Hard | 162/140 |
| 8,550,340 | B2 * | 10/2013 | Schutzmann et al. | 235/379 |
| 8,919,821 | B2 * | 12/2014 | Reid et al. | 283/108 |
| 2006/0016557 | A1 * | 1/2006 | Howland et al. | 156/290 |
| 2008/0216976 | A1 * | 9/2008 | Ruck et al. | 162/110 |
| 2014/0238628 | A1 * | 8/2014 | Seidler et al. | 162/116 |
| 2014/0332174 | A1 * | 11/2014 | Pretsch | D21H 21/42 162/140 |

FOREIGN PATENT DOCUMENTS

| | | | | |
|---|---|---|---|---|
| DE | 102009022612 | A1 * | 12/2010 | B42D 15/00 |
| EP | 1002640 | A1 | 5/2000 | |
| GB | 2395959 | A | 6/2004 | |
| WO | 93/01057 | A1 | 1/1993 | |
| WO | WO 03070482 | A1 * | 8/2003 | B42D 15/00 |

OTHER PUBLICATIONS

International Preliminary Report on Patentability from International Application PCT/EP2012/004155, Apr. 8, 2014.

Chinese Search Report from Chinese Application No. 2012800586892, Feb. 5, 2015.

* cited by examiner

METHOD AND DEVICE FOR MANUFACTURING A SHEET-LIKE SUBSTRATE

BACKGROUND

The present invention relates to a method and a device for manufacturing a sheet-type substrate having a security thread, especially a banknote paper having a security thread.

SUMMARY

To detect the stretch of a security thread embedded in a banknote paper, stretch-sensitive magnetic features that are integrated into the security thread are, for example, detected with a sensor that is arranged after a dryer section of the paper machine for manufacturing the banknote paper.

Such a magnetic measurement is very distance-sensitive and thus difficult to carry out.

Proceeding from this, it is the object of the present invention to provide an improved method for manufacturing a sheet-type substrate having a security thread. Further, an improved device for manufacturing a sheet-type substrate having a security thread is to be provided.

According to the present invention, the object is solved by a method for manufacturing a sheet-type substrate having a security thread, especially a banknote paper having a security thread, in which a) a security thread having features spaced apart from one another in the longitudinal direction of the security thread is inserted into the substrate in such a way that it is at least partially embedded in the substrate,
b) at least one of the features is displayed as an image after the embedding of the security thread,
c) the stretch of the embedded security thread in the longitudinal direction is calculated based on the image of the at least one feature, and
d) the region of the substrate in which the calculated stretch of the security thread exceeds a specified maximum stretch is obliterated depending on the calculated stretch.

Due to the display of the at least one feature as an image, the strong distance dependency between the sheet-type substrate and the sensor, as in the case of the magnetic markings, is no longer present. What is essential is only that an image of the feature is obtained with such a resolution that permits a calculation of the stretch of the embedded security thread based on the image.

Due to the good and precise detection of the stretch of the security thread and the corresponding obliteration upon exceedance of the maximum stretch provided for, it can be ensured that the non-obliterated sheet-type substrate includes no overstretched security thread. Thus, with the method according to the present invention, sheet-type substrate can be manufactured having an extremely small share of defects with respect to the thread overstretch. The method according to the present invention provides an extremely reliable and good waste recognition and obliteration.

To carry out step d), the region of the substrate in which the calculated stretch of the security thread exceeds the specified maximum stretch can be marked, for example with a waste mark. All marked regions or regions provided with a waste mark are considered to be obliterated and can, for example, later (e.g. at the cross cutter) be withdrawn.

In step a), especially an aqueous fiber mass that includes a mixture of water and fibers can be deposited on a support surface, and the security thread embedded in the deposited fiber mass under traction or under tension.

Further, in the method according to the present invention, in step c), the spacing of two features in the longitudinal direction can be evaluated to calculate the stretch. For this, in step b), the images of preferably at least two features are recorded in a common recording. This can be realized in that, with an image sensor, a recording is carried out in which the at least two features are included.

Additionally or alternatively, in step c), at least one dimension of the at least one feature (e.g. the spread of the at least one feature in the longitudinal direction of the security thread) can be evaluated to calculate the stretch. Additionally or alternatively, the spread of the feature transversely to the longitudinal direction can be evaluated to calculate the thread stretch.

In particular, in step c), a pattern matching can be carried out between the at least one recorded feature and a stored target image of the feature. Such a pattern matching can be carried out automatically with high precision. In particular, in such a pattern matching, the distortions of the recorded feature caused by the stretch of the security thread can be taken into account.

The features can be so-called cleartext (gaps in the form of a number, letter and/or character string in an opaque coating). Alternatively, the features can also be present in the form of so-called positive text (opaque coating in the form of a number, letter and/or character string in transparent surroundings) or a combination of the two forms. The features can also include or depict geometric patterns. For example, the feature can exhibit a quadratic or rectangular shape. In particular, the features can be such features that, on the security thread, already serve to verify the authenticity of the sheet-type substrate in which the security thread is embedded. Thus, no additional features need be provided that serve only to verify the thread stretch upon manufacture of the sheet-type substrate.

The features are preferably developed periodically on the security thread in the longitudinal direction.

In the method according to the present invention, step a) of the embedding of the security thread can be controlled depending on the stretch calculated in step c) to prevent an exceedance of the specified maximum stretch of the security thread.

In the method according to the present invention, the sheet-type substrate having the embedded security thread can be manufactured in a paper manufacturing machine having a moving mold, step b) being carried out immediately after the substrate is removed from the mold. In this way, the still damp or wet substrate can be verified immediately after its manufacture with a view to the stretch of the security thread, such that, in the event that an overstretching of the security thread is present, the waste can be minimized.

Alternatively, in the method according to the present invention, the sheet-type substrate having the embedded security thread can be manufactured in a paper manufacturing machine having a moving mold, step b) being carried out at the end of the paper manufacturing machine. In particular, step b) can be carried out after a dryer section of the paper manufacturing machine, or shortly before the winding of the sheet-type substrate.

In step b), the recording can be carried out in transmitted light or reflected light. In particular, the recording can be carried out with light from the visible wavelength range, IR radiation and/or UV radiation.

In the method according to the present invention, in step d), the mechanical tension of the security thread can be controlled at embedding in step a), such that an overstretching of the embedded thread is prevented to the greatest extent possible.

The security thread can also be developed as a security foil or other elongated security element. The security element preferably exhibits the features periodically spaced apart from each other in the longitudinal direction.

The sheet-type substrate manufactured with the method according to the present invention and having the at least partially embedded security thread can also be referred to as security paper, and serve to manufacture value documents, such as banknotes.

The security thread can exhibit a width in the range from 0.2 to 40 mm, especially in the range from 1 to 12 mm, and particularly preferably in the range from 1 to 6 mm. The features preferably exhibit a size of at least 0.2 mm. The spacing of two consecutive features is preferably less than one sheet length of the sheet-type substrate. In this way, it can be ensured that each sheet having an overstretched security thread can be reliably obliterated, since the stretch can be determined at least once per sheet. The spacing of two immediately consecutive features can lie in the range from 5 to 35 mm. This can be the case, for example, when the sheets serve to manufacture banknotes, and 5 to 12 banknotes are to be manufactured per sheet in the longitudinal direction of the security thread. Since the features are to be included at least in each banknote, half the banknote height can be chosen as the spacing of two immediately consecutive features.

At the insertion of the security thread according to step a) into the substrate, the position of the security thread can oscillate transversely to its longitudinal direction. Said lateral variation in the position of the security thread is, of course, taken into account in step d).

Further is provided a device for manufacturing a sheet-type substrate having a security thread, especially a banknote paper having a security thread, having a substrate module that inserts into the substrate, in such a way that it is at least partially embedded in the substrate, a security thread having features spaced apart from one another in the longitudinal direction of the security thread, an image recording module that displays at least one of the features as an image after the embedding of the security thread, a control unit that calculates the stretch of the embedded security thread in the longitudinal direction based on the image of the at least one feature, and having an obliteration module that, depending on the stretch calculated by the control unit, obliterates the region of the substrate in which the calculated stretch of the security thread exceeds a specified maximum stretch.

With the device according to the present invention, the stretch of the embedded security thread can be calculated reliably and with high precision. In this way, it is possible to manufacture a sheet-type substrate that includes, with the greatest reliability, no overstretched security thread (the regions having an overstretched security thread have been obliterated according to the present invention).

In the device, the control unit can evaluate the spacing of two features in the longitudinal direction to calculate the stretch. Further, the control unit can additionally or alternatively evaluate a dimension of the at least one feature (for example, its spread in the longitudinal direction of the security thread and/or transversely thereto) to calculate the stretch.

Further, the control unit can, in the device according to the present invention, carry out a pattern matching between the at least one recorded feature and a stored target image of the feature. In this way, it can be ensured that even features that are distorted due to the stretch of the security thread can easily be recognized and evaluated.

In the device according to the present invention, the control unit can control, depending on the calculated stretch, via the substrate module, the embedding of the security thread to prevent an exceedance of the specified maximum stretch of the security thread. Thus it is possible to manufacture the sheet-type substrate having the embedded security thread with extremely little waste.

Further, the device according to the present invention can be developed as a paper manufacturing machine (e.g. as a cylinder mold machine), and the substrate module exhibit a moving mold to manufacture the substrate, the image recording module being arranged immediately after the mold. In this way, the embedded security thread can be detected still in the damp and not yet dried sheet-type substrate, such that the waste in the event of an overstretching of the security thread can be minimized.

Alternatively, the image recording module can be arranged at the end of the paper manufacturing machine. In particular, the image recording module can be arranged after the dryer section or immediately before the winding of the substrate.

The image recording module can record the image or images of the at least one feature in transmitted light or reflected light. In particular, the image recording module can record multiple features simultaneously in one recording.

Further, in the device according to the present invention, the control unit can control, with the substrate module, the mechanical tension of the security thread upon embedding in the substrate. In particular, the substrate module can exhibit a tensile-force-regulated thread winding for this.

It is understood that the features mentioned above and those still to be explained below are usable not only in the stated combinations, but also in other combinations or alone, without departing from the scope of the present invention.

BRIEF DESCRIPTION OF THE DRAWINGS

Below, the present invention is explained in greater detail by way of example, by reference to the attached drawings, which also disclose features essential to the present invention. To improve clarity, a depiction to scale and proportion was dispensed with in the drawings. Shown are.

DETAILED DESCRIPTION OF VARIOUS EMBODIMENTS

Figure 1:
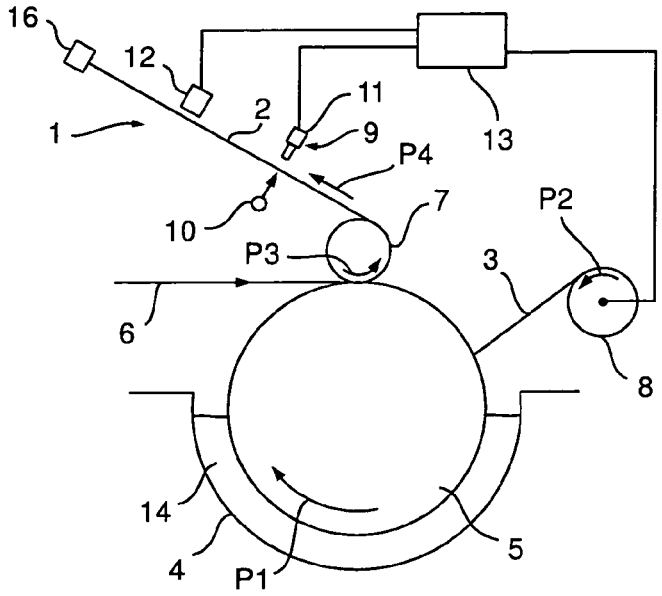
FIG. 1 a schematic diagram of an embodiment of the device according to the present invention for manufacturing a sheet-type substrate having a security thread, FIG. 2 a schematic top view of a portion of a security thread to be embedded, FIG. 3 a schematic top view of a section of the sheet-type substrate to explain the precisely registered introduction of the security thread, and FIG. 4 a top view according to FIG. 3 to explain an alternative to the precisely registered introduction of the security thread.

In the embodiment shown schematically in FIG. 1, the device according to the present invention for manufacturing a substrate having a security thread is developed as a paper manufacturing machine of the cylinder mold type and exhibits a mold trough 4 in which a cylinder mold 5 immerges.

Further, the device 1 comprises a removal mold 6 and a removal roll 7 to remove the substrate 2 formed on the cylinder mold 5.

The device 1 further comprises a feed module 8 for feeding the security thread 3 to the cylinder mold 5 to at least partially embed the security thread 3 in the substrate 2 in a known manner under traction, an image recording module 9 having an illumination unit 10 and a camera 11, an obliteration module 12 and a control unit 13. The feed module 8 provides a tensile-force-regulated thread winding, such that a desired mechanical thread tension (in the longitudinal direction of the security thread 3) can be set upon introducing the security thread 3.

The device 1 can exhibit, after the obliteration module 12, yet further modules known to the person of skill in the art, such as a press section, a dryer section, a winding, etc. A processing module 16 is drawn in in FIG. 1 representatively for said modules.

In the operation of the device 1, sufficient pulp 14 is fed to the mold trough 4 such that, upon rotation of the cylinder mold 5 (arrow P1), the desired substrate 2 is formed on the cylinder mold 5. Since, further, the security thread 3 is fed with the feed module 8 (indicated by arrow P2), said security thread 3 can be at least partially embedded (e.g. as a window thread) in the substrate 2 in a known manner. Of course, also a complete embedding is possible. The operation of the device is carried out in a known controlled or regulated manner. This can occur, for example, through the control unit 13 or a control unit not shown.

The substrate 2 formed in this way having the embedded security thread 3 is removed from the cylinder mold 5 with the removal mold 6 and the removal roll 7 (arrow P3) and runs as a substrate web (here still in the aqueous and not yet dried state) through the image recording module 9 (indicated by arrow P4).

The cylinder mold 5, the mold trough 4, the feed module 8, the removal mold 6 and the removal roll 7 together can also be referred to as the substrate module.

With the image recording module 9, features 15 that are periodically arranged in the longitudinal direction of the security thread 3 are recorded as images and fed to the control unit 13.

Figure 2:
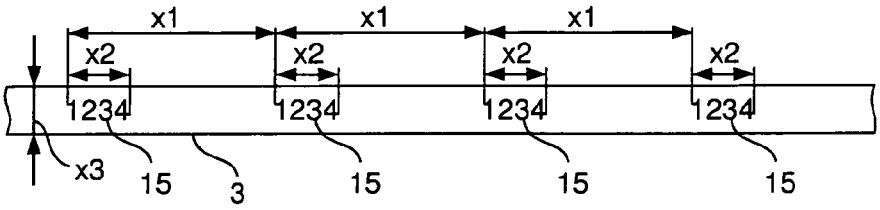

Such features 15 (here, as an example of so-called cleartext, the number string 1234) are depicted in FIG. 2. As can be seen in the diagram, the spacing of two adjacent features 15 is thus the period length x1, and the spread of each feature 15 in the longitudinal direction of the security thread 3 is, in each case, x2.

The values for x1 and x2 in the unstretched state of the security thread 3 are known. The recordings are preferably carried out in such a way that at least two features 15 are displayed on each recording. Based on the images of the features 15 of the embedded security thread 3, the control unit 13 calculates the actual stretch present in the longitudinal direction of the security thread 3 in the embedded state.

For instance, the control unit 13 can calculate the value for the spacing x1 of two adjacent features 15 of the embedded security thread 3 and compare it with a target value. If the calculated value for x1 is less than or equal to the target value, the tension of the security thread 3 can, for example, be maintained upon feeding. If the target value is exceeded, the stretch of the security thread 3 in the embedded state is too large. The tension upon feeding the security thread 3 is therefore reduced to reduce the stretch of the security thread 3 for the further production of the substrate 2.

Of course, it is also possible to reduce the tension upon feeding the security thread 3 if the calculated value is close to the target value. For this, one or more regions can, for example, be specified. If the calculated value for the spacing x1 lies in one of these regions, then a corresponding reduction of the tension of the fed security thread 3 is effected.

Further, the control unit 13 can address the obliteration module 12 if the calculated value for the spacing x1 lies above the target value, so that the corresponding region of the substrate 2 in which the stretch of the security thread 3 is too large is obliterated.

The control unit 13 can additionally or alternatively evaluate the value for the spacing x2 based on the images of the features 15. The evaluation occurs in a similar manner as for the value x1. If a target value is exceeded, there is a too-high thread stretch, such that, on one hand, the tension upon feeding of the security thread 3 is reduced, and on the other hand, the corresponding region of the substrate 2 is obliterated with the obliteration module 12.

The device according to the present invention 1 thus exhibits a control loop that ensures a quick reaction to an overstretching of the security thread 3. Further, all regions or sheets having an overstretched security thread 3 can be reliably obliterated and thus sorted out at the latest when cutting to size.

To calculate the spacing x1 and/or x2 from the image(s) of the features 15, a pattern matching, for example, can be carried out between a stored pattern (target pattern) of the feature 15 and the recorded feature 15. With such a pattern matching, the spacing value x1 and/or x2 can quickly be calculated at high precision. In particular, with the pattern matching, the features can be unambiguously recognized in the recordings, even if they are deformed to different extents due to the existing stretch of the embedded security thread 3.

Of course, the features 15 can be developed not only as cleartext. It is also possible that the features 15 include geometric shapes or are developed as such. For example, rectangular marks can be used.

As depicted schematically in FIG. 1, the image recording module 9 provides a transmitted light illumination. This is easily possible, for example in an illumination with wavelengths from the visible wavelength range.

Alternatively, it is, of course, also possible to provide a reflected light illumination. Further, additionally or alternatively to the illumination with light from the visible wavelength range, an illumination with UV and/or IR radiation can be carried out, especially in an image recording in reflected light.

Since the image recording module 9 carries out the image recordings immediately after the substrate 2 having the embedded security thread 3 is removed, and thus still before the dryer section of the paper manufacturing machine 1, the waste can quickly be recognized and obliterated. Furthermore, too large a thread stretch can be detected and corrected very quickly. In this way, the waste at substrate manufacture can also be minimized.

Further, in addition to the described evaluation according to the present invention, also the thread width x3 of the embedded thread 3 can be calculated from the recordings. In this way, a further parameter is available, such that the determination of the existing stretch of the security thread 3 in the longitudinal direction can be done yet more precisely.

Of course, the image recording module 9 can be arranged at yet other locations of the device 1, that are then spaced further apart from the removal roll 7. In all embodiments, the obliteration module 12 is arranged at such a spacing from the image recording module 9 that a sure and reliable obliteration can occur when the overstretching of the security thread 3 is ascertained.

Figure 3:
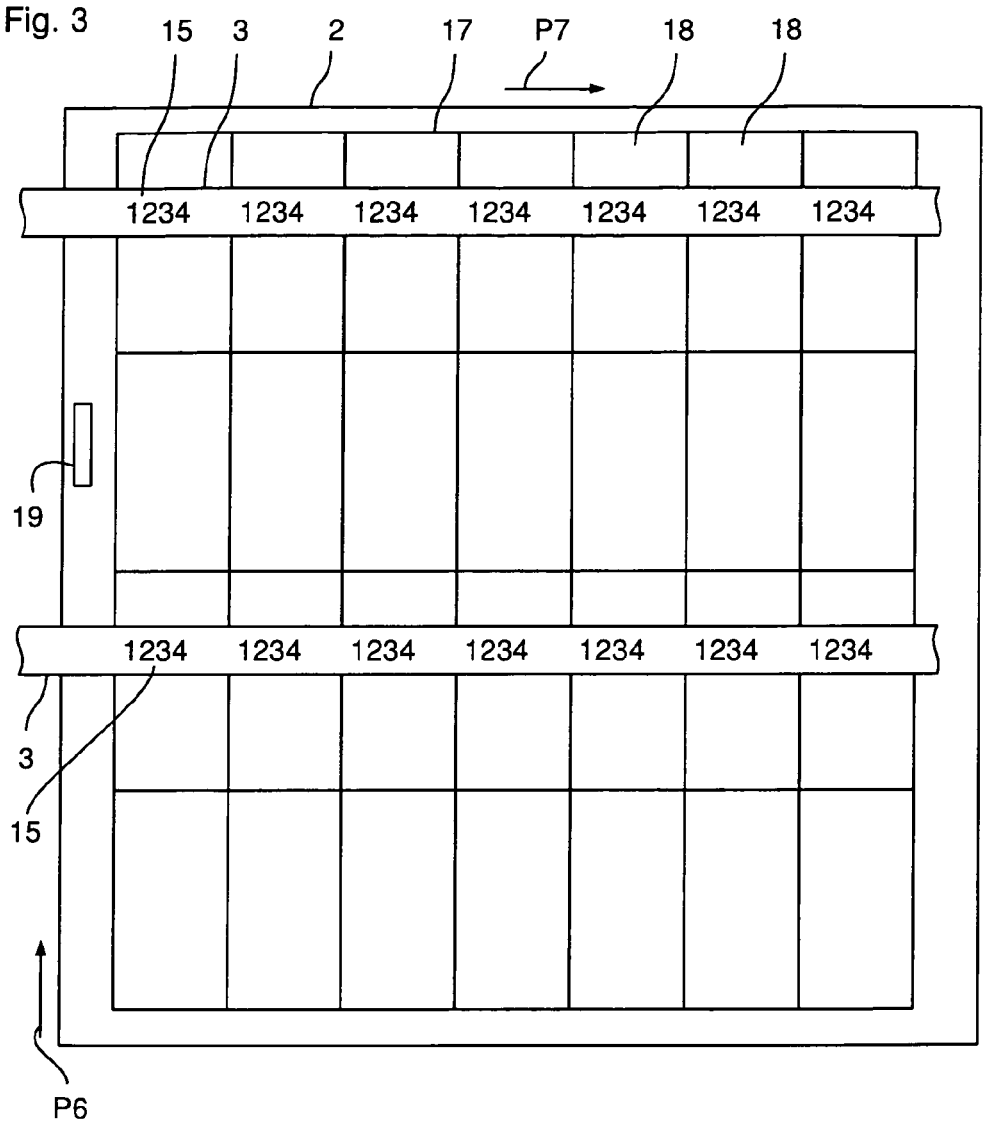

Further, a precisely registered introduction of the security thread 3 into the substrate 2 is possible with the device 1 according to the present invention. Precisely registered thread introduction means that the security thread must be stretched to the sheet dimension of a sheet 17 (FIG. 3) of the sheet-type substrate 2 and, additionally, a feature 15 of each introduced security thread is placed to a reference mark 19 in the sheet 17. In FIG. 3, two security threads 3 are shown that are each placed in the sheet 2 with respect to the reference mark 19, which can be, for example, a watermark. The regions 18 indicate the banknotes to be manufactured, all regions 18 forming the so-called up region of the sheet 2.

Through the positioning with respect to the reference mark 19, the features 15 of the security thread 3 can be positioned in the longitudinal direction of the security thread (direction P7) with respect to the up region. Further, the reference mark 19 also serves to position the security threads 3 in the transverse direction (arrow P6).

Figure 4:
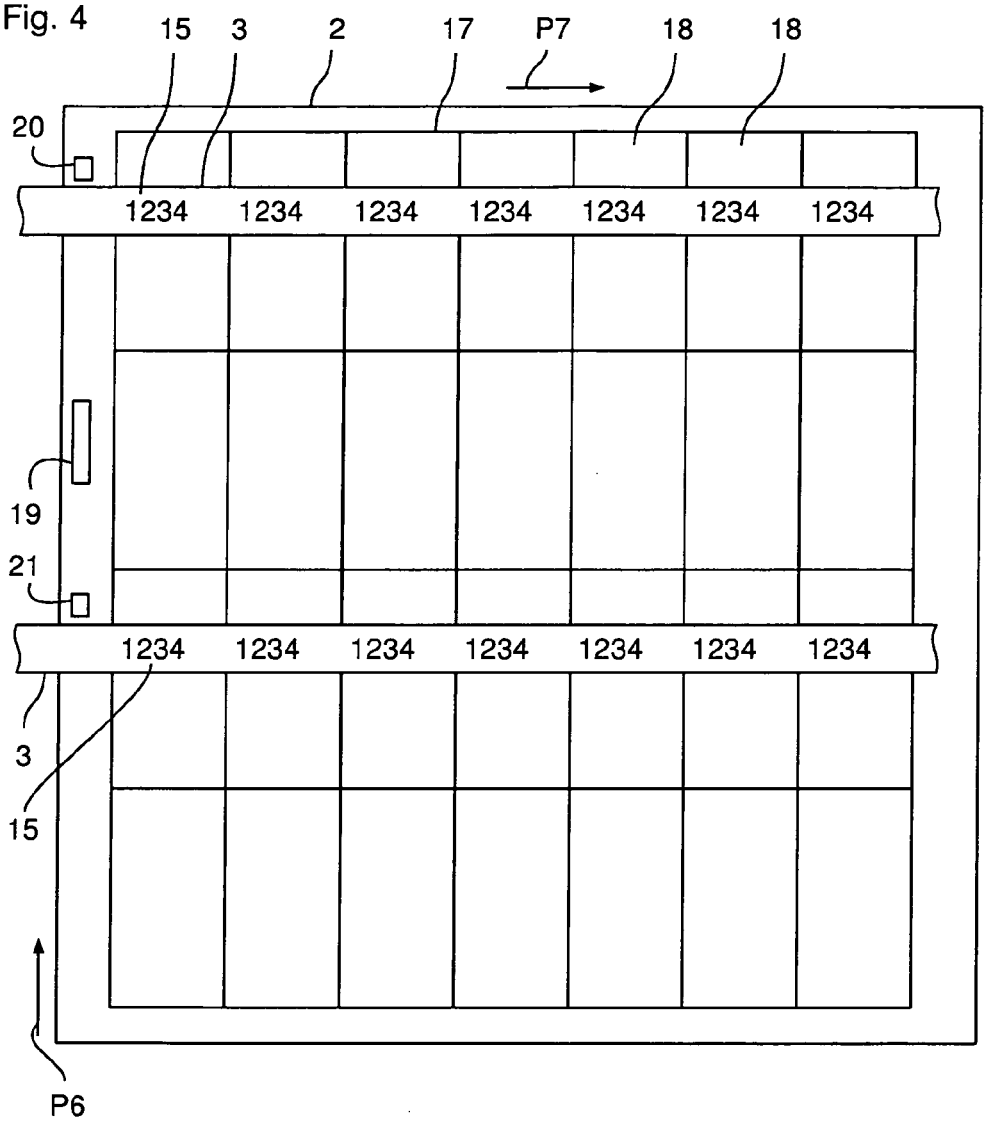

In FIG. 4, a modification is shown in which the reference mark 19 serves only to position the security threads in the transverse direction (arrow P6). For the positioning in the longitudinal direction of the security threads 3, a separate reference mark 20, 21 is provided for each security thread 3.

LIST OF REFERENCE SIGNS

1 Device
2 Substrate
3 Security thread
4 Mold trough
5 Cylinder mold
6 Removal mold
7 Removal roll
8 Feed module
9 Image recording module
10 Illumination unit
11 Camera
12 Obliteration module
13 Control unit
14 Pulp
15 Feature
16 Processing module
17 Sheet
18 Banknote
19-21 Reference mark
P1-P7 Arrow
x1 Period length
x2 Spread of the feature in the longitudinal direction
x3 Thread width

The invention claimed is:

1. A method for manufacturing a sheet-type substrate having a security thread, comprising:

a) inserting a security thread having features spaced apart from one another in the longitudinal direction of the security thread into the substrate in such a way that it is at least partially embedded in the substrate;

b) displaying at least one of the features as an image after the embedding of the security thread;

c) calculating the stretch of the embedded security thread in the longitudinal direction based on the image of the at least one feature; and d) depending on the calculated stretch, obliterating the region of the substrate in which the calculated stretch of the security thread exceeds a specified maximum stretch.

2. The method according to claim 1, in which, in step c), the spacing of two features in the longitudinal direction is evaluated to calculate the stretch.

3. The method according to claim 1, in which, in step c), a dimension of the at least one feature is evaluated to calculate the stretch.

4. The method according to claim 1, in which, in step c), a pattern matching is carried out between the at least one recorded feature and a stored target image of the feature.

5. The method according to claim 1, in which step a) of the embedding of the security thread is controlled depending on the stretch calculated in step c) to prevent an exceedance of the specified maximum stretch of the security thread.

6. The method according to claim 1, in which the substrate having the embedded security thread is manufactured in a paper manufacturing machine having a moving mold, step b) being carried out immediately after the substrate is removed from the mold.

7. The method according to claim 1, in which the substrate having the embedded security thread is manufactured in a paper manufacturing machine having a moving mold, step b) being carried out at the end of the paper manufacturing machine.

8. The method according to claim 1, in which, in step b), the recording is produced in transmitted light.

9. The method according to claim 1, in which, in step b), the recording is carried out in reflected light.

10. The method according to claim 1, in which, in step d), the mechanical tension of the security thread is controlled upon embedding in step a).

11. The method according to claim 1, in which the features are gaps in the form of a number, letter and/or character string, in an opaque coating.

* * * * *